US007458548B2

(12) United States Patent
Franzone, Jr. et al.

(10) Patent No.: US 7,458,548 B2
(45) Date of Patent: Dec. 2, 2008

(54) REMOVABLE SHELF LOCKING SYSTEM

(75) Inventors: Andrew Lawrence Franzone, Jr., Westhampton, NY (US); Robert Ahearn, Bethpage, NY (US)

(73) Assignee: Allen Field Company, Inc., Farmingdale, NY (US)

( * ) Notice: Subject to any disclaimer, the term of this patent is extended or adjusted under 35 U.S.C. 154(b) by 0 days.

(21) Appl. No.: 11/729,134

(22) Filed: Mar. 27, 2007

(65) Prior Publication Data

US 2008/0237423 A1 Oct. 2, 2008

(51) Int. Cl.
*E04G 3/20* (2006.01)

(52) U.S. Cl. ..... 248/250; 248/544

(58) Field of Classification Search ..... 248/235, 248/239, 250, 544; 108/108, 152; 206/1.5
See application file for complete search history.

(56) References Cited

U.S. PATENT DOCUMENTS

| | | | | |
|---|---|---|---|---|
| 3,471,111 | A | 10/1969 | MacDonald | 248/235 |
| 3,471,112 | A | 10/1969 | MacDonald et al. | 248/239 |
| 4,037,813 | A * | 7/1977 | Loui et al. | 248/250 |
| 4,732,358 | A * | 3/1988 | Hughes et al. | 248/243 |
| 4,819,901 | A | 4/1989 | McDonald | 248/250 |
| 4,830,323 | A | 5/1989 | Harley | 248/250 |
| 5,080,311 | A * | 1/1992 | Engstrom | 248/250 |
| 5,195,708 | A * | 3/1993 | Marsh | 248/250 |
| 6,186,456 | B1 | 2/2001 | Marsh | 248/243 |
| 6,464,186 | B1 * | 10/2002 | Marsh | 248/243 |
| 6,554,236 | B2 | 4/2003 | Marsh | 248/235 |
| 7,055,788 | B2 | 6/2006 | Migli | 248/239 |
| 2002/0166934 | A1 | 11/2002 | Marsh | 248/235 |
| 2004/0232297 | A1 | 11/2004 | Migli | 248/250 |

* cited by examiner

*Primary Examiner*—Ramon O Ramirez
(74) *Attorney, Agent, or Firm*—Harrington & Smith, PC

(57) ABSTRACT

Disclosed herein is a shelf locking system. The shelf locking system includes a shelf support and a shelf lock. The shelf support is configured to contact a first side of a shelf. The shelf lock is removably engageable with the shelf support. The shelf lock includes a body section and a first contact member. The first contact member extends from the body section. The shelf lock is installed in one of two positions. The first contact member is configured to contact a second side of the shelf when the shelf lock is in the first position. The first contact member is configured to contact a third side of the shelf when the shelf lock is in the second position.

20 Claims, 4 Drawing Sheets

REMOVABLE SHELF LOCKING SYSTEM

BACKGROUND OF THE INVENTION

1. Field of the Invention

The present invention relates to a shelf support system and, more particularly, to a shelf locking system.

2. Brief Description of Prior Developments

U.S. Pat. Nos. 7,055,788 and 6,554,236 disclose shelf supports having various locking configurations. These locking configurations generally provide support features adapted to secure a shelf in an installed configuration for consumer use. Additionally, the aforementioned configurations require visible elements projecting beyond the shelving areas which may consume a portion of the shelf's useful space. Many shelving units are shipped in an assembled state and are subjected to excessive vibration, drops, or other inadvertent handling operations which can cause damage to shelving unit parts and components. Shelves within a cabinet or shelving unit are particularly likely to become displaced and fall off their corresponding shelf supports during shipping. This may cause damage to the shelf itself or other cabinet components. In order to minimize and/or prevent damage during shipping and handling, there is a desire to provide a robust, yet aesthetically pleasing, shelf support configuration.

Accordingly, there is a need for an improved shelf locking system.

SUMMARY OF THE INVENTION

In accordance with one aspect of the present invention, a shelf locking system is disclosed. The shelf locking system includes a shelf support and a shelf lock. The shelf support is configured to contact a first side of a shelf. The shelf lock is removably engageable with the shelf support. The shelf lock includes a body section and a first contact member. The first contact member extends from the body section. The shelf lock is installed in one of two positions. The first contact member is configured to contact a second side of the shelf when the shelf lock is in the first position. The first contact member is configured to contact a third side of the shelf when the shelf lock is in the second position.

In accordance with another aspect of the present invention, a cabinet shelf locking system is disclosed. The cabinet shelf locking system includes a shelf support and a shelf lock. The shelf support is configured to be insertable into a cabinet wall. The shelf support comprises a first surface and a second surface. The first surface is configured to contact a first side of a cabinet shelf. The shelf lock includes two contact members and a latch arm member. The two contact members are configured to contact a second side of the cabinet shelf. The latch arm member is configured to extend between the cabinet wall and an end of the cabinet shelf. The latch arm member includes a latch contact area engageable with the second surface.

In accordance with yet another aspect of the present invention, a shelf locking system is disclosed. The shelf locking system includes a shelf support and a shelf lock. The shelf support includes a first surface, a first end, and a first portion. The first surface is configured to contact a first side of a shelf. The first end is substantially perpendicular to the first surface. The first portion extends from the first end. The shelf lock is configured to contact a second side of the shelf. The shelf lock includes a body section and two arm members extending from the body section. At least one of the two arm members is resiliently deflectable. The two arm members are configured to receive the first portion therebetween.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
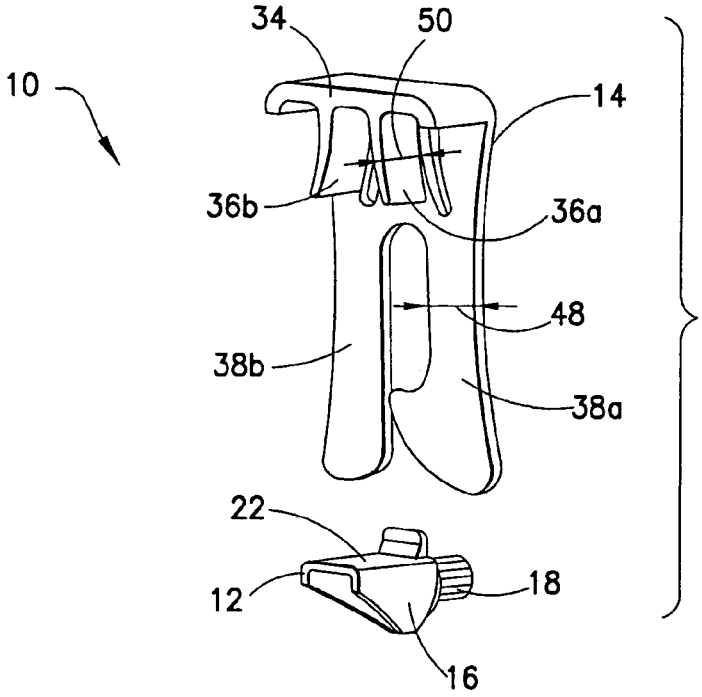
FIG. 1 is a perspective view of a shelf locking system.

Referring to FIG. 1, there is shown a perspective view of a shelf locking system 10 incorporating features of the present invention. Although the present invention will be described with reference to the exemplary embodiment shown in the drawings, it should be understood that the present invention can be embodied in many alternate forms of embodiments. In addition, any suitable size, shape or type of elements or materials could be used.

The shelf locking system 10 includes a shelf support 12 and a removable shelf lock 14. The shelf lock 14 is removably engageable with the shelf support 12. The shelf lock 14 and the shelf support 12 provide for an improved shelf locking system 10 which secures and protects cabinet shelf parts/components while being shipped.

Figure 2:
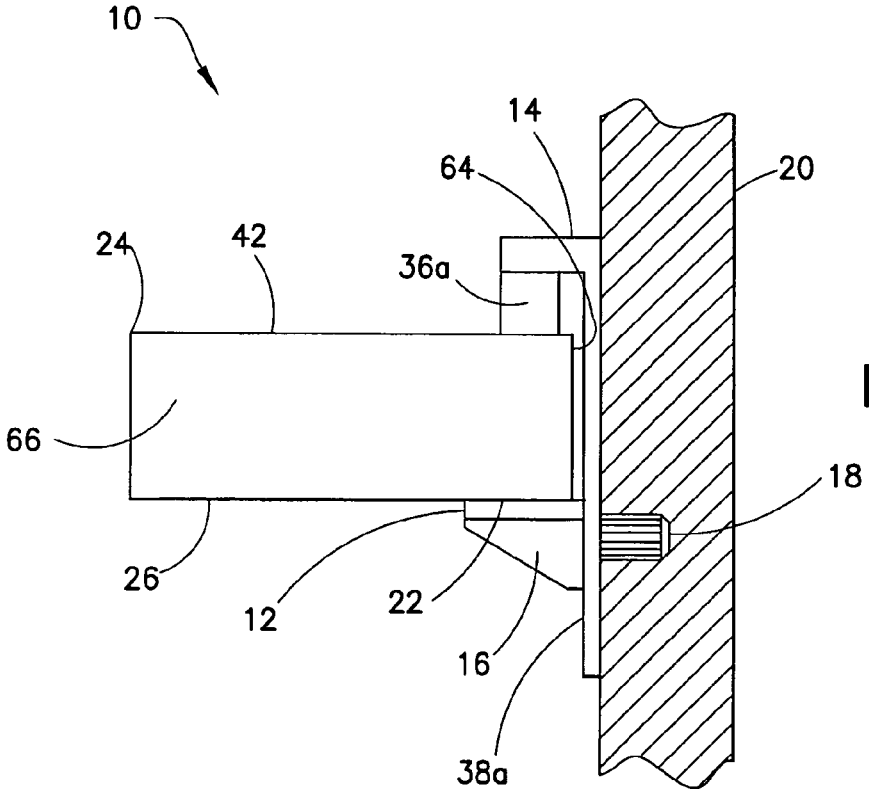
FIG. 2 is front view of the shelf locking system shown in FIG. 1 installed within a cabinet wall.
Figure 3:
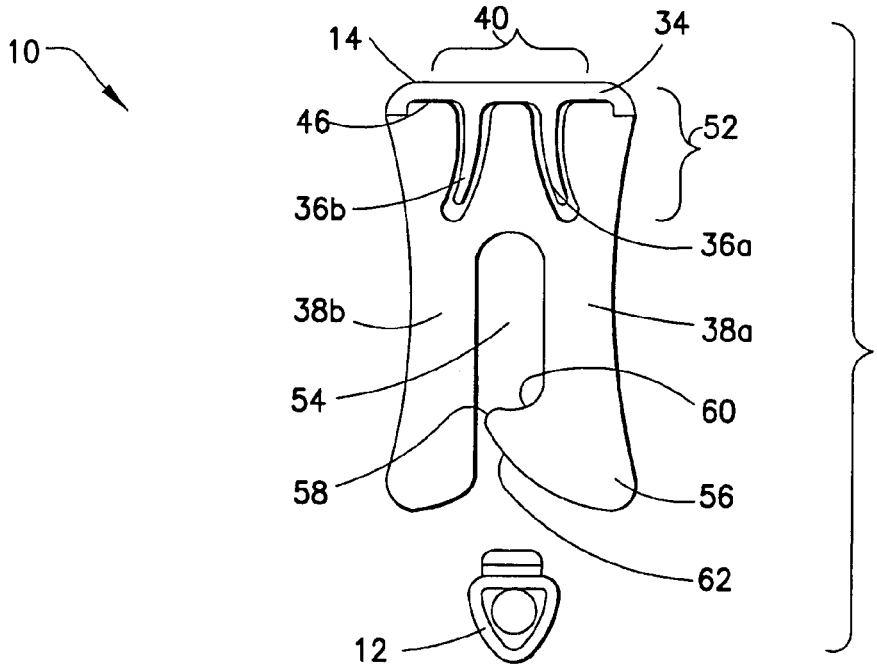
FIG. 3 is a left side elevational view of the shelf locking system shown in FIG. 1.
Figure 4:
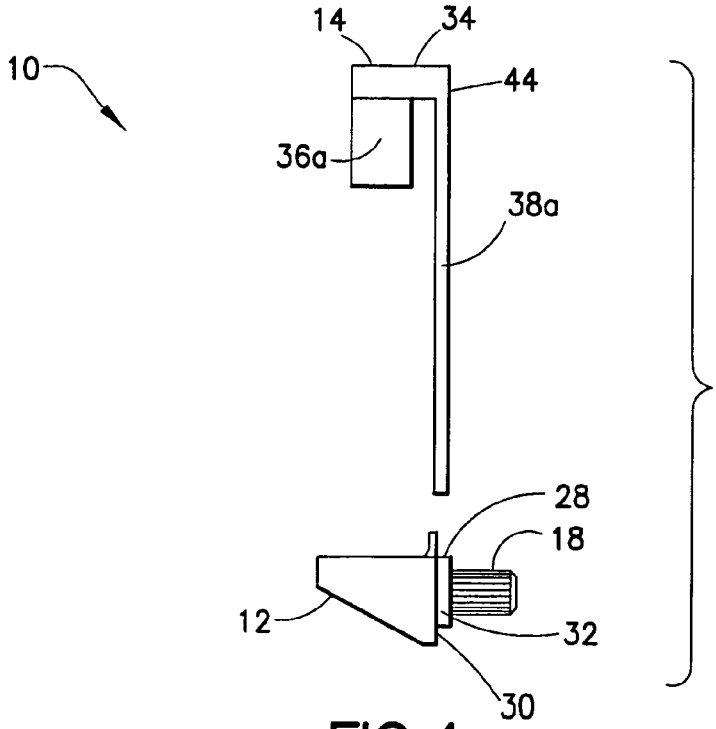
FIG. 4 is a front elevational view of the shelf locking system shown in FIG. 1.

Referring now also to FIGS. 2-4, the shelf support 12 comprises a support body section 16, and a pin member 18. The pin member 18 is configured to be insertable into a cabinet wall 20. The support body section 16 comprises a contact surface, or first surface, 22 (further illustrated in FIGS. 3 and 4) which is configured to be in contact with a shelf 24. The shelf support 12 supports the shelf 24 at a first side, or bottom side, 26. The shelf support also comprises a latch portion, or first portion, 28 (best shown in FIG. 4). The latch portion 28 extends from an end, or first end, 30 of the support body section 16 to the pin member 18. The latch portion 28 may comprise a cylindrical shape with a cylindrical outer surface 32. The shelf support 12 may be comprised from plastic and/or metal, or any other suitable material. Additionally, the shelf support may be a one-piece or a two-piece member.

The shelf lock 14 comprises a body section 34, two contact members 36*a*, 36*b* and two arm members 38*a*, 38*b* (best illustrated in FIGS. 3 and 4). The shelf lock 14 is a one-piece member which may be formed from plastic for example. The two contact members 36*a*, 36*b* extend from a middle portion 40 of the body section 34. The two contact members 36*a*, 36*b* have a suitable length for contacting a top side, or second side, 42 of the shelf 24. Additionally, the two contact members 36*a*, 36*b* may extend in a general curvilinear fashion such that the two contact members 36*a*, 36*b* curve away from one another.

However, it should be noted that contact members having any suitable shape for contacting the shelf may be provided.

The two arm members 38*a*, 38*b* extend from a first lateral side 44 of the body section 34. The two arm members 38*a*, 38*b* extend in generally the same direction (a direction away from a bottom side 46 of the body section 34) as the two contact members 36*a*, 36*b*. Additionally, the orientation of the arm members 38*a*, 38*b* to the contact members 36*a*, 36*b* may be provided such that a width 48 of the arm members 38*a*, 38*b* is generally perpendicularly oriented relative to a width 50 of the contact members 36*a*, 36*b* (see FIG. 1). The two arm members 38*a*, 38*b* extend from the first lateral side 44 and form a common arm member section 52 before extending as two separate arm members. The two arm members 38*a*, 38*b* extend from the common arm member section 52 with suitable dimensions to allow for a slotted opening 54 between the two arm members 38*a*, 38*b*. One of the arm members, which may also be referred to as a latch arm member, 38*a* comprises a contoured end 56 which extends towards the other arm member 38*b* to form a substantially closed end 58 of the slotted opening 54. Additionally, an inner edge of the contoured end 56 provides a latch contact area 60 and an outer edge may provide a lead-in feature 62 to facilitate reception of the latch portion 28. It should be noted that one or both of the arm members 38*a*, 38*b* may be resiliently deflectable to allow for receiving the latch portion 28 of the shelf support 12. The two arm members 38*a*, 38*b* have a suitable length for extending beyond the shelf 24 and allowing for engagement with the shelf support 12.

It should be noted that although the arm members 38*a*, 38*b* are joined proximate the body section 34, the arm members 38*a*, 38*b* may extend separately from the lateral side 44. Additionally, although the figures illustrate the arm member 38*a* comprising the contoured end 56 and the latch contact area 60, an alternate embodiment may provide the reverse configuration such that the arm member 38*b* comprises the contoured end and the latch contact area. Further, another alternate embodiment may provide arm members (having contoured ends and latch contact areas) that are substantially mirror images of each other.

Figure 5:
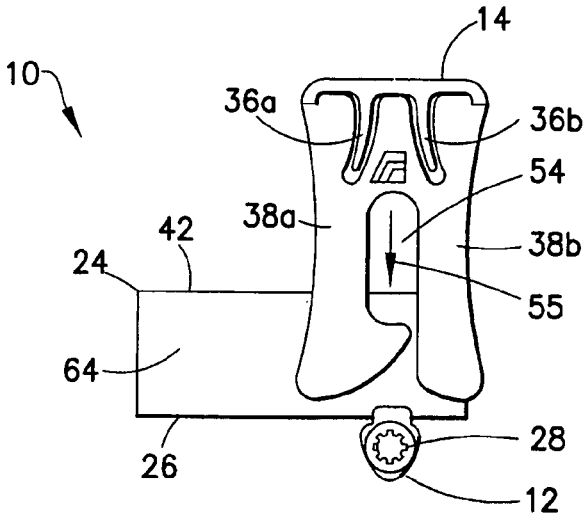
FIG. 5 is a right side elevational view of the shelf locking system shown in FIG. 1 in an aligned position prior to installation.
Figure 6:
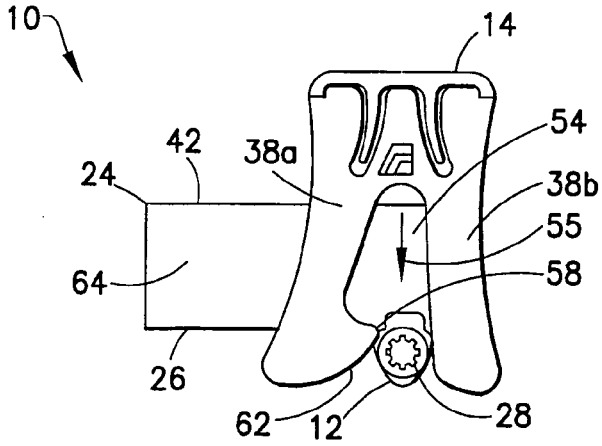
FIG. 6 is a right side elevational view of the shelf locking system shown in FIG. 1 in a partially installed orientation.
Figure 7:
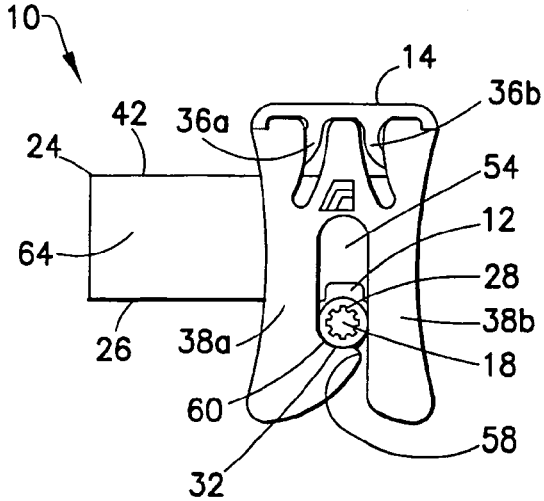
FIG. 7 is a right side elevational view of the shelf locking system shown in FIG. 1 in a fully installed orientation.

The shelf lock 14 removably attaches to the shelf support 12 as illustrated in FIGS. 5-7. To engage the shelf lock 14 with the shelf support 12, the shelf lock 14 is positioned such that the arm members 38*a*, 38*b* extend between the cabinet wall 20 (not shown in FIGS. 5-7 for purposes of clarity) and an end 64 of the cabinet shelf 24. The two extending arms 38*a*, 38*b* are then aligned with the shelf support 12 wherein the slotted opening 54 is oriented opposite the latch portion 28 (see FIG. 5). To attach the shelf lock 14 to the shelf support 12, the shelf lock 14 is advanced in a direction (represented by arrow 55) towards the shelf support 12 wherein the latch portion 28 is received between the arm members 38*a*, 38*b*. One or both of the arm members 38*a*, 38*b* resiliently deflect to separate the arm members and open the substantially closed end 58 of the slotted opening 54 (see FIG. 6). The lead-in feature 62 facilitates the deflection of the arm member(s) 38*a*, 38*b* and guides the latch portion 28 towards the slotted opening 54. As shown in FIG. 7, the shelf lock 14 is then fully advanced until the latch portion 28 is within the slotted opening 54 and the contact members 36*a*, 36*b* are against the second side 42 of the shelf 24. The arm members 38*a*, 38*b* resiliently deflect back towards each other to form the substantially closed end 58 of the slotted opening 54. This retains the shelf lock 14 engaged with the shelf support 12 as the latch contact area 60 is fitted against the latch surface 32. It should be understood that although the figures illustrate the latch portion 28 as having a greater diameter than the pin 18, alternate embodiments may comprise latch portions having a diameter equal to or less than the pin diameter.

When the shelf lock 14 and the shelf support 12 are joined together and sandwich the cabinet shelf 24 (shelf support contact surface 22 on a first side 26 and contact members 36*a*, 36*b* on a second side 42), they secure the shelf 24 for protection during shipping. The shelf support 12 and the shelf lock 14 provide a clamping force to the shelf 24 such that the shelf 24 does not move relative to the cabinet wall 20. Once the cabinets are installed, the shelf lock 14 can be separated and removed from the shelf support 12. The removable shelf lock 14 can be discarded. The shelf support 12 remains in the cabinet to support the cabinet shelf 24.

Figure 8:
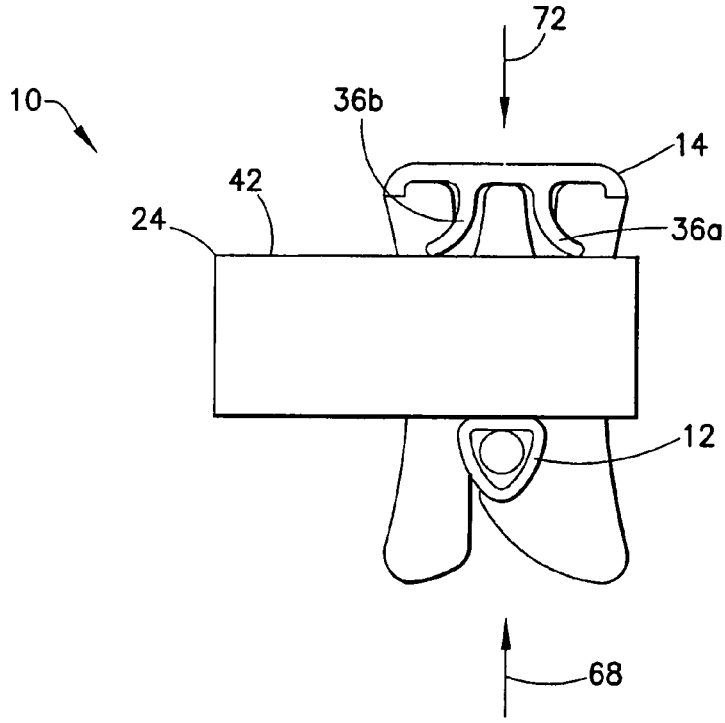
FIG. 8 is a left side elevational view of the shelf locking system shown in FIG. 1 in a first position.
Figure 9:
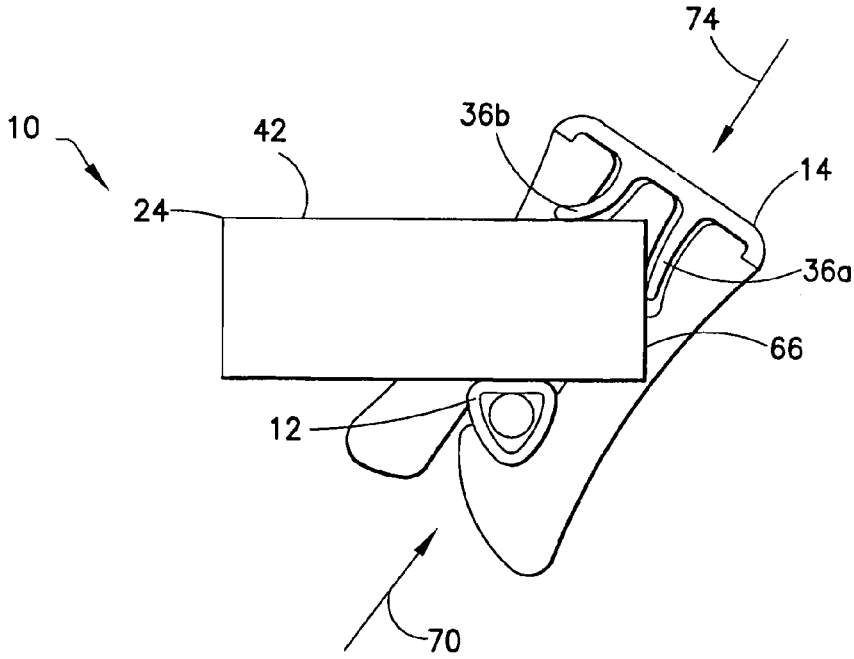
FIG. 9 is a left side elevational view of the shelf locking system shown in FIG. 1 in a second position.

The removable shelf lock 14 may be installed in one of two positions as illustrated in FIGS. 8-9. The removable shelf lock 14 may be mounted on the top side 42 of the shelf to hold the shelf 24 down (see FIG. 8). This configuration allows both contact members 36*a*, 36*b* to support the second side (or top side) 42 of the shelf 24. This configuration may be utilized when it is desired to restrain the shelf 24 from translating in a vertical direction (direction perpendicular to the second side 42) during shipping and/or handling. Additionally, the contact members 36*a*, 36*b* may provide a friction force (or clamping force) to the top side 42 of the shelf 24 to secure the shelf 24 in a horizontal direction.

The removable shelf lock may also be mounted on a front edge, or third side, 66 of the shelf 24 to hold the shelf 24 down and in (see FIG. 9). This configuration allows the first contact member 36*a* to support the third side 66 of the shelf 24 and the second contact member 36*b* to support the second side 42. This configuration may be utilized when it is desired to restrain the shelf 24 from translating in a vertical direction and a horizontal direction during shipping and/or handling.

In both of the positions described above, the direction of a holding force (represented by arrows 68, 70) generated between the removable shelf lock 14 and the shelf support 12 is generally in line with an installation direction (represented by arrows 72, 74) of the shelf lock 14 to the shelf support 12 (except opposite). The opposite directions of the holding force 68, 70 and the installation direction 72, 74 provide for a holding force that is not generated perpendicular to the installation direction. For example in the first position (FIG. 8), the holding force 68 is generated in a direction opposite to the installation direction 72. The holding force 68 is not generated in a direction perpendicular to the installation direction 72 (or parallel to the top side 42 of the shelf 24). Similarly, in the second position (FIG. 9), the holding force 70 is generated in a direction opposite to the installation direction 74. The holding force 70 is not generated in a direction perpendicular to the installation direction 74.

It should be understood that although the figures illustrate the latch portion 28 as having a cylindrical shape, any suitable shape for providing a latching surface and latching engagement may be provided. It should also be understood that although the figures illustrate the shelf lock 14 as engaging with the latching surface 32 of the shelf support 12, in an alternate embodiment, the shelf lock may engage a portion of the pin member.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A shelf locking system comprising:

a shelf support configured to contact a first side of a shelf; and a shelf lock removably engageable with the shelf support, wherein the shelf lock is configured to be removable from the shelf support when at least a portion of the shelf support is installed in a cabinet wall, wherein the shelf lock comprises a body section and a first contact member extending from the body section, wherein the shelf lock is installed in one of two positions, wherein the first contact member is configured to contact a second side of the shelf when the shelf lock is in the first position, and wherein the first contact member is configured to contact a third side of the shelf when the shelf lock is in the second position.

2. The shelf locking system of claim 1 wherein the shelf lock further comprises a second contact member extending from the body section.

3. The shelf locking system of claim 2 wherein the first contact member and the second contact member extend from a middle portion of the body section.

4. The shelf locking system of claim 1 wherein the first contact member is configured to contact a top side of the shelf when the shelf lock is in the first position, and wherein the first contact member is configured to contact a side of the shelf that is substantially perpendicular to the top side when the shelf lock is in the second position.

5. A shelf locking system comprising:

a shelf support configured to contact a first side of a shelf; and a shelf lock removably engageable with the shelf support, wherein the shelf lock comprises a body section and a first contact member extending from the body section, wherein the shelf lock is installed in one of two positions, wherein the first contact member is configured to contact a second side of the shelf when the shelf lock is in the first position, wherein the first contact member is configured to contact a third side of the shelf when the shelf lock is in the second position, wherein the shelf lock further comprises a second contact member extending from the body section, and wherein the second contact member is configured to contact the second side of the shelf when the shelf lock is in the first position and the second position.

6. A shelf locking system comprising:

a shelf support configured to contact a first side of a shelf; and a shelf lock removably engageable with the shelf support, wherein the shelf lock comprises a body section and a first contact member extending from the body section, wherein the shelf lock is installed in one of two positions, wherein the first contact member is configured to contact a second side of the shelf when the shelf lock is in the first position, wherein the first contact member is configured to contact a third side of the shelf when the shelf lock is in the second position, and wherein the shelf lock further comprises two arm members extending from a lateral side of the body portion.

7. The shelf locking system of claim 6 wherein at least one of the two arm members is resiliently deflectable.

8. The shelf locking system of claim 6 wherein the shelf lock is configured to receive a portion of the shelf support between the two arm members.

9. A cabinet shelf locking system comprising:

a shelf support configured to be insertable into a cabinet wall, wherein the shelf support comprises a first surface and a second surface, and wherein the first surface is configured to contact a first side of a cabinet shelf; and a shelf lock comprising two contact members and a latch arm member, wherein the two contact members are configured to contact a second side of the cabinet shelf, wherein the latch arm member is configured to extend between the cabinet wall and an end of the cabinet shelf, and wherein the latch arm member comprises a latch contact area engageable with the second surface.

10. The cabinet shelf locking system of claim 9 wherein the second surface is a cylindrical surface extending from an end of the shelf support.

11. The cabinet shelf locking system of claim 10 wherein the cylindrical surface is between the end of the shelf support and a pin member of the shelf support.

12. The cabinet shelf locking system of claim 11 wherein the cylindrical surface is concentric to the pin member, and wherein the cylindrical surface has a greater diameter than the pin member.

13. The cabinet shelf locking system of claim 9 wherein the latch arm member is configured to be resiliently deflectable.

14. The cabinet shelf locking system of claim 9 wherein a width of each of the two contact members is substantially perpendicular to a width of the latch arm member.

15. A shelf locking system comprising:

a shelf support comprising a first surface, a first end, and a first portion, wherein the first surface is configured to contact a first side of a shelf, wherein the first end is substantially perpendicular to the first surface, and wherein the first portion extends from the first end; and a shelf lock configured to contact a second side of the shelf, wherein the shelf lock comprises a body section and two arm members extending from the body section, wherein at least one of the two arm members is resiliently deflectable, and wherein the two arm members are configured to receive the first portion therebetween.

16. The shelf locking system of claim 15 further comprising a first contact member and a second contact member extending from the body section.

17. The shelf locking system of claim 16 wherein the first contact member is configured to contact the second side when the shelf lock is in a first position.

18. The shelf locking system of claim 16 wherein the first contact member is configured to contact a third side of the shelf when the shelf lock is in a second position.

19. The shelf locking system of claim 16 wherein the second contact member is configured to contact the second side when the shelf lock is in a first position or a second position.

20. The shelf locking system of claim 15 wherein the first portion extends between the first end and a pin member of the shelf support.

* * * * *